United States Patent [19]

Carroll et al.

[11] 4,205,749

[45] Jun. 3, 1980

[54] NESTABLE AND STACKABLE CONTAINER

[75] Inventors: James C. Carroll; Victor D. Johns, both of Hopkinsville, Ky.

[73] Assignee: Phillips Petroleum Company, Bartlesville, Okla.

[21] Appl. No.: 7,521

[22] Filed: Jan. 29, 1979

[51] Int. Cl.[2] ..... B65D 21/04

[52] U.S. Cl. ..... 206/507; 206/504; 220/23.4; 220/23.6

[58] Field of Search ..... 206/505, 506, 507, 504; 220/23.4, 23.6

[56] References Cited

U.S. PATENT DOCUMENTS

| | | | |
|---|---|---|---|
| Re. 26,758 | 1/1970 | Kreeger | 206/507 |
| 2,064,518 | 12/1936 | Brogden | 220/23.4 |
| 3,341,053 | 9/1967 | Keene | 220/23.4 |
| 3,420,402 | 1/1969 | Frater | 206/507 |
| 3,443,722 | 5/1969 | Cloyd | 206/507 |
| 3,547,309 | 12/1970 | Pusey | 220/23.4 |
| 3,622,031 | 11/1971 | Wells | 206/507 |
| 3,773,213 | 11/1973 | Frederick | 206/507 |
| 3,944,074 | 3/1976 | Riley | 220/23.4 |
| 4,011,948 | 3/1977 | Rehrig | 206/507 |
| 4,106,623 | 8/1978 | Carroll | 206/507 |

FOREIGN PATENT DOCUMENTS

| | | | |
|---|---|---|---|
| 7508378 | 7/1975 | Netherlands | 220/23.4 |
| 211801 | 3/1967 | Sweden | 206/507 |

*Primary Examiner*—George E. Lowrance

[57] ABSTRACT

A nestable and stackable container for eggs packaged in cartons. The configuration of the container permits stacking when filled or nesting when empty and is provided with means for receiving and positioning packaging strapping material about the exterior of the container to facilitate assembly of multiple containers for palletizing and shipping.

6 Claims, 10 Drawing Figures

66
66
66

NESTABLE AND STACKABLE CONTAINER

The invention relates generally to containers. In one aspect the invention relates to a container adapted for alternately nesting and stacking with at least one container identical thereto.

It is conventional practice to merchandise eggs and cartons each containing one dozen eggs. The filled cartons are shipped to retailers in cases or crates each holding a plurality of layers of multiple cartons, typically five layers of three cartons each, or fifteen cartons per crate. A typical egg carton is a single piece, molded pulp or paperboard carton folded along a horizontal fold line to form the top and bottom portions of the crate, with the closed carton having an outwardly extending flange along the two ends and one side at the juncture of the top and bottom portions.

The crates employed in handling and transporting egg cartons have in the past taken various forms, including wooden slat boxes, wire frame crates and even paperboard cartons, with the wire frame construction currently being one of the most commonly used. These prior art crates or boxes have not been entirely satisfactory for many reasons. For example, the open construction of the wire frame crate has not always adequately protected the egg cartons from damage through the walls of the crate, and the wooden crates and/or paperboard boxes have been easily damaged, difficult or impossible to clean, and generally have not presented an acceptable appearance for use in merchandising eggs directly to the customer. Further, the individual crates and/or boxes of the prior art have generally not been capable of nesting when empty, making their storage, handling and transportation more difficult and costly.

In recent years, there has been a growing trend on behalf of retailers to place filled egg crates on display to the general public, and let the customer take the individual cartons of eggs directly from the crates. This practice has resulted in an increased use of the wire frame crate which permits the individual cartons to be price stamped through openings in the side walls of the crate without removing the cartons therefrom. More recent advances in the design of crates include the manufacture of crates of unitary thermoplastic construction. Such crates are generally light in weight, strong in construction and easily cleaned so as to maintain a pleasing appearance to the public, thus facilitating the merchandising of eggs directly to the customer. It is desirable during the shipment of crates of eggs to assemble a plurality of crates on a pallet to provide economy and safety of handling large numbers of crates. Typically, a palletized load of egg crates comprises sixty crates arranged three crates wide by four crates deep by five crates high. It is desirable in assembling such palletized loads to strap each successive stack of twelve crates into a relatively rigid unit or assmebly which can be conveniently disassembled at the point of retail merchandising. Suitable straps for assembling such palletized loads are made of steel or synthetic resinous material. The prior art molded, unitary, thermoplastic crates have generally provided smooth exterior surfaces which fail to precisely position packaging straps applied to the crates and many times allow such straps to damage the eggs carried within the crates during the assembly of a palletized load.

Accordingly it is an object of the present invention to provide an improved container constructed from molded plastic material, preferably molded thermoplastic material, which avoids the foregoing and other defects of the prior art containers. Another object of the invention is to provide an improved egg crate which is attractive and pleasing in appearance to the customer when employed for merchandising eggs directly from the crates. Yet another object of the invention is to provide a molded plastic container provided with means for receiving and precisely positioning packaging strapping material applied thereto so as to guard against load shifting and damage of egg cartons during shipping and handling. Still another object of the invention is to provide a nestable and stackable container configured so as to facilitate nesting and stacking operations.

In accordance with the present invention, there is provided a stackable and nestable container comprising a generally rectangular bottom portion having a generally rectangular outer margin having first, second, third and fourth sides, and a plurality of horizontally spaced, substantially vertically oriented members extending upwardly from the first, second, third and fourth sides. The container further includes a lower end face on each of at least a portion of the substantially vertically oriented members extending downwardly and outwardly from a respective one of the sides of the generally rectangular outer margin and spaced a distance vertically upward from a downwardly facing surface of the generally rectangular outer margin. A generally rectangular upper outer rim extends about the upper end portions of at least a portion of the substantially vertically oriented members, and is characterized by an upper end face comprising a substantially horizontal upwardly facing portion and an upwardly facing chamfered portion extending downwardly and inwardly from the upwardly facing portion. An upper end face is formed on each of at least a portion of the substantially vertically oriented members extending upwardly and inwardly from a substantially vertical inner surface of the generally rectangular upper outer rim and spaced a distance vertically downward from the upper end face of the generally rectangular upper outer rim. A generally rectangular intermediate outer rim extends about the outwardly facing surfaces of the medial portion of at least a portion of the substantially vertically oriented members and is characterized by four corners. The container is further provided with strapping guide means positioned adjacent each of the corners of the generally rectangular intermediate outer rim intermediate the generally rectangular intermediate outer rim and the generally rectangular upper outer rim for receiving strap means so as to secure a plurality of the containers together to form an assembly of the containers.

Other aspects, objects and advantages of the invention will become apparent from the following detailed description, claims and the drawings, in which:

Figure 1:
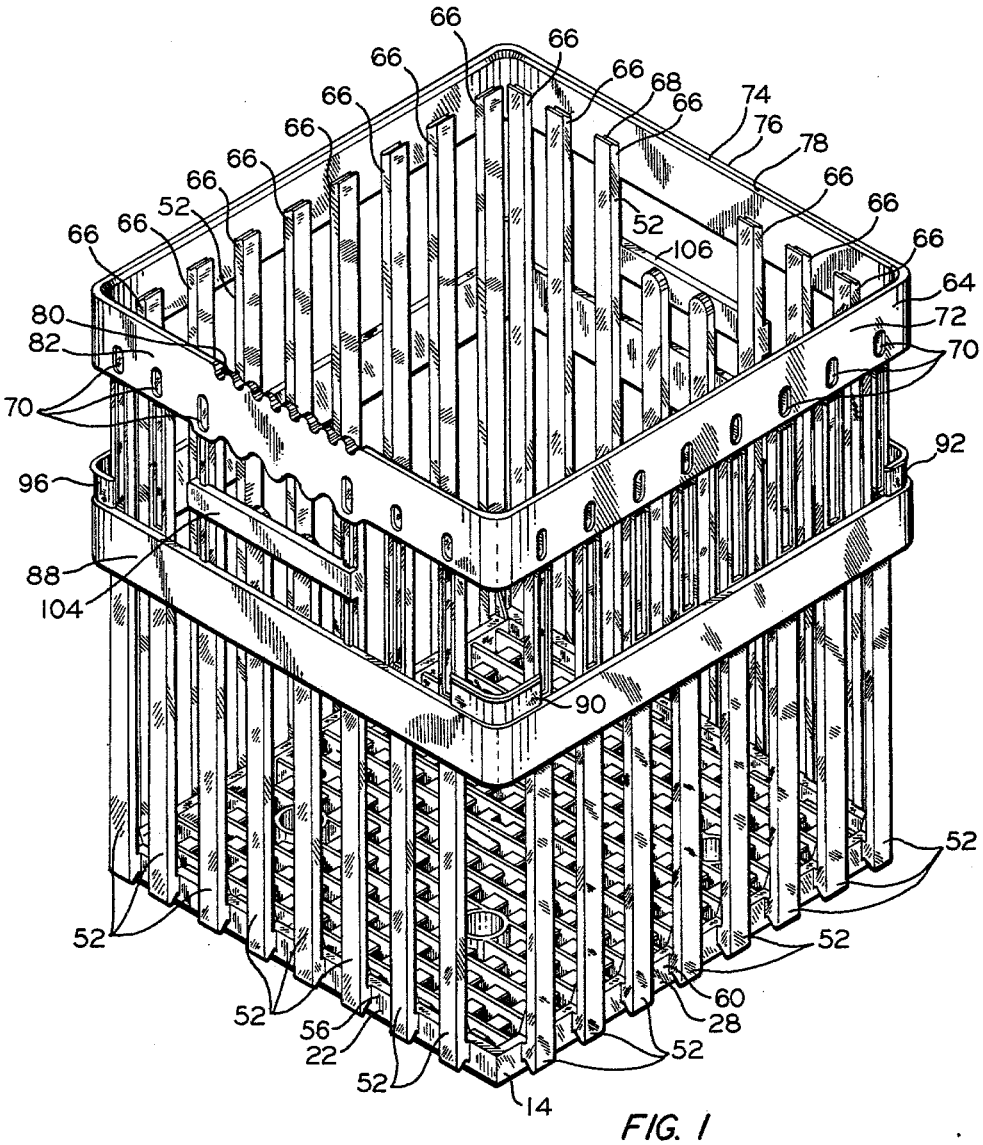
FIG. 1 is an isometric view of a nestable and stackable container constructed in accordance with the present invention.
Figure 2:
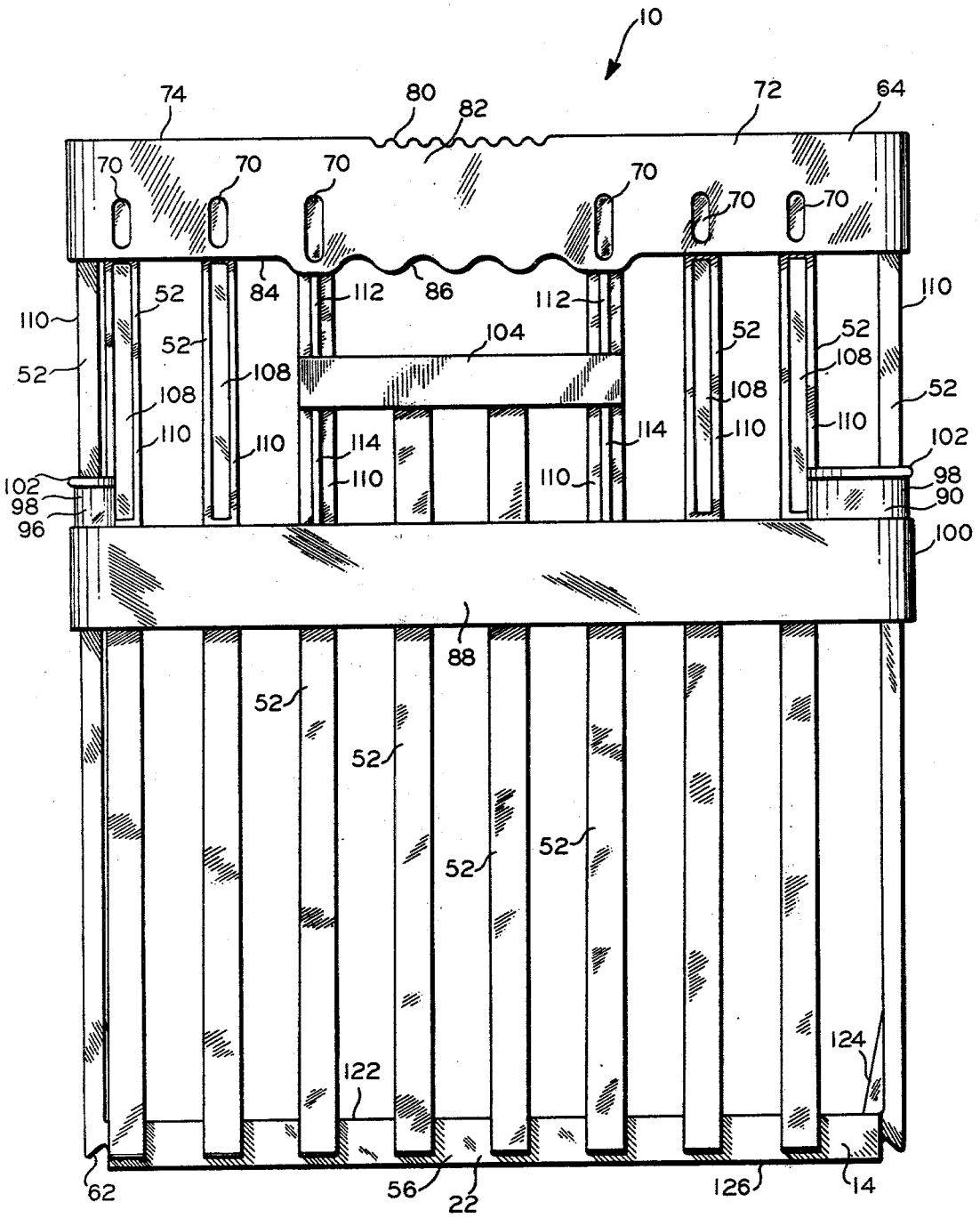
FIG. 2 is a front elevation view of the container.
Figure 3:
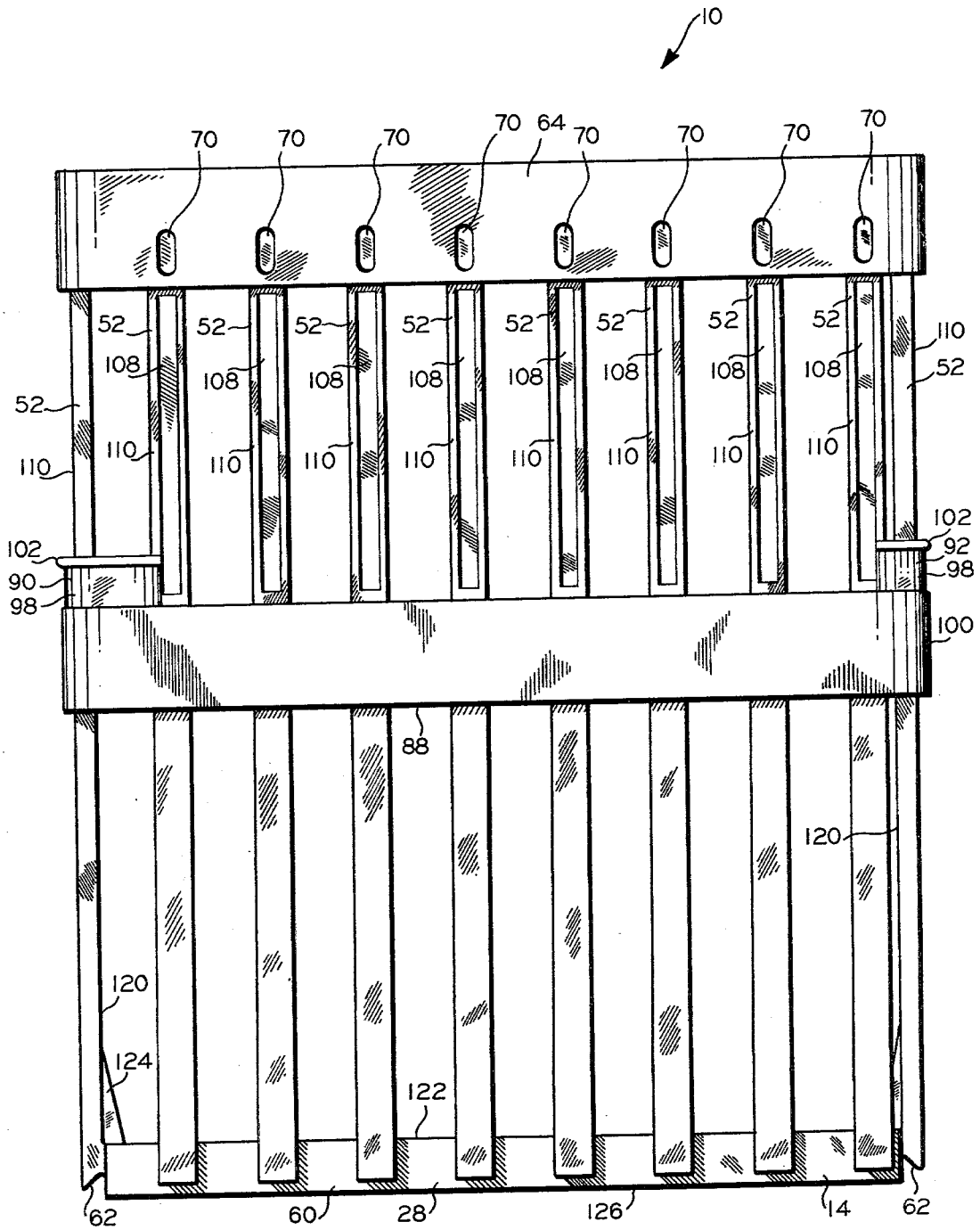
FIG. 3 is a right side elevation view of the container.
Figure 4:
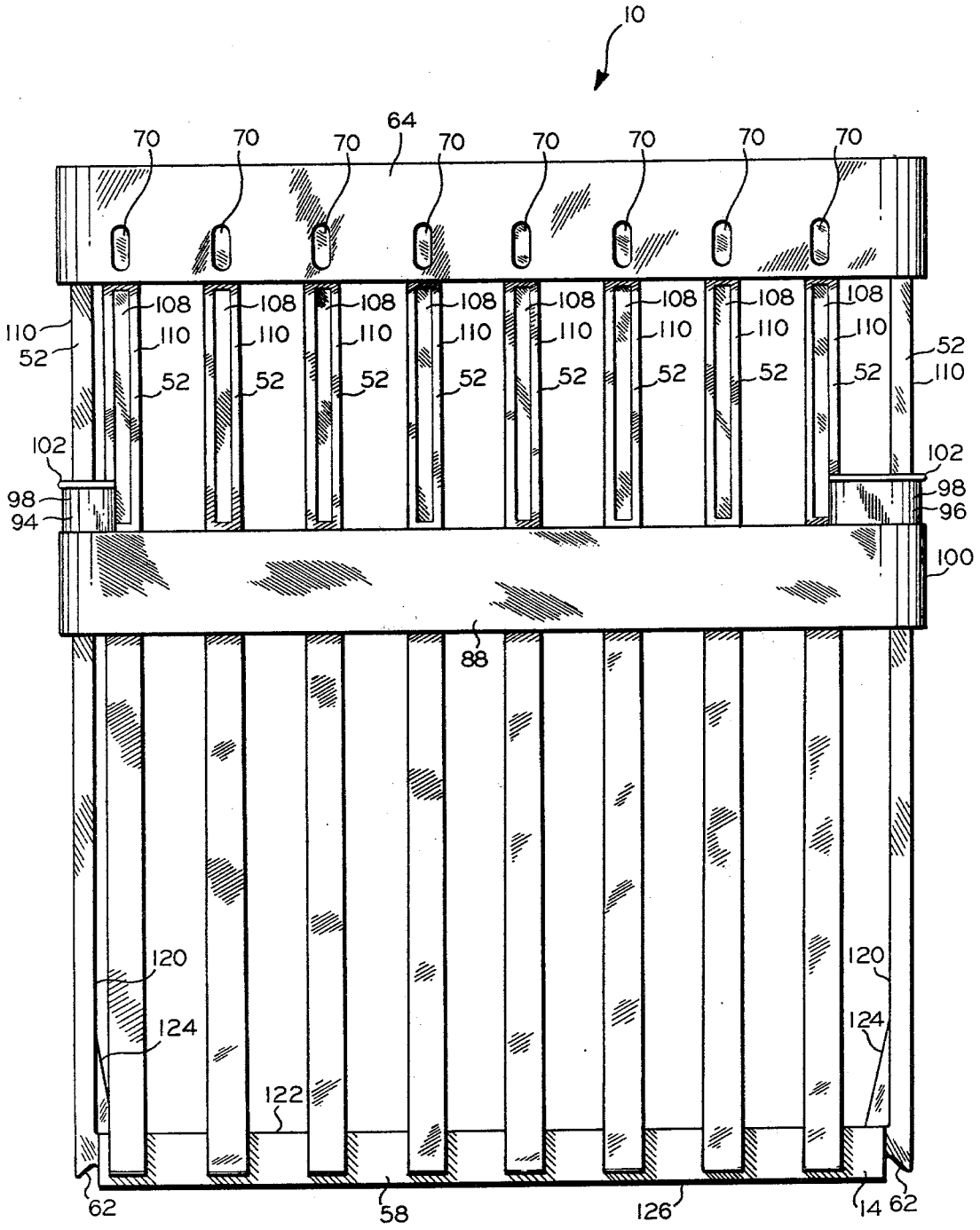
FIG. 4 is a left side elevation view of the container.
Figure 5:
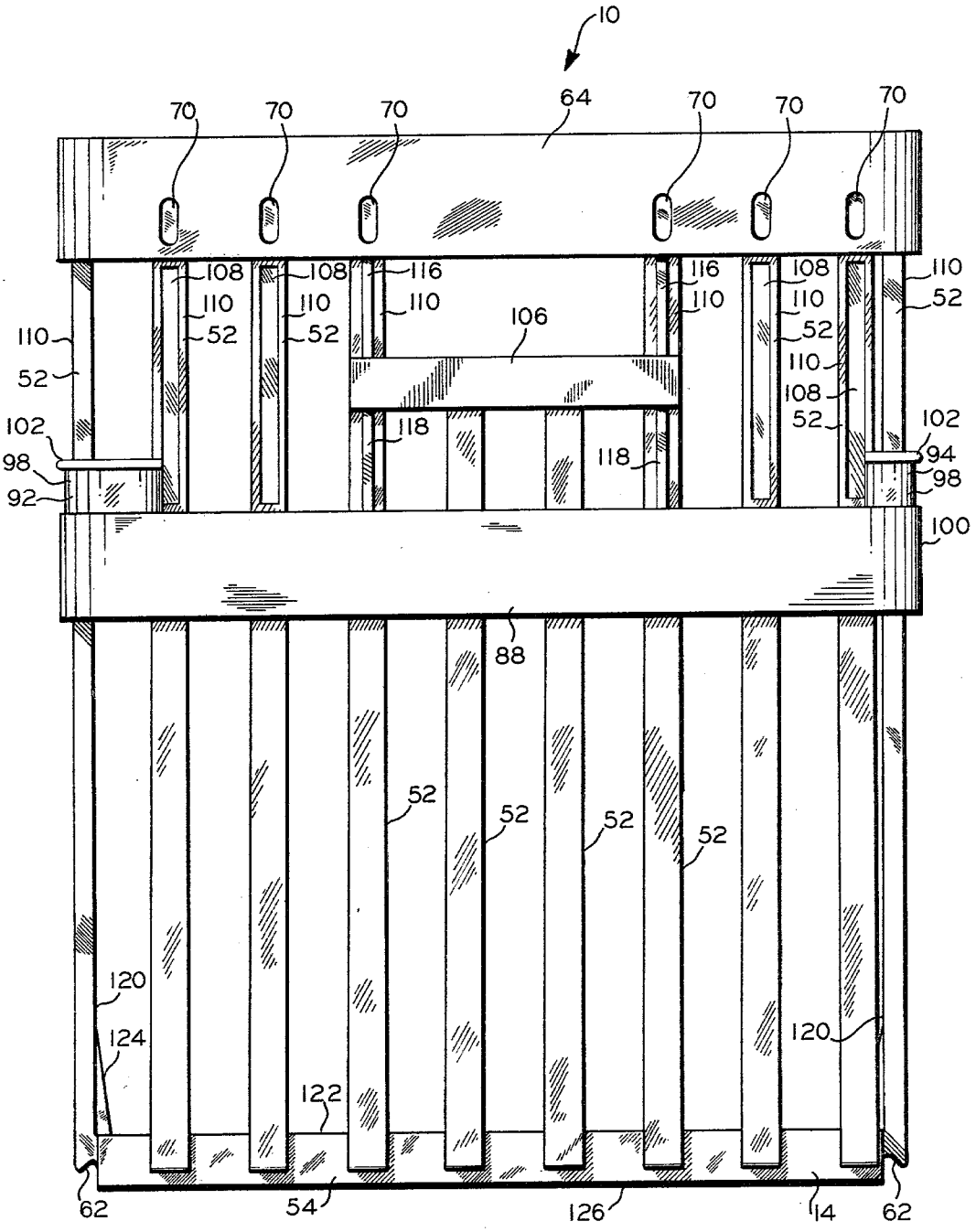
FIG. 5 is a rear elevation view of the container.
Figure 6:
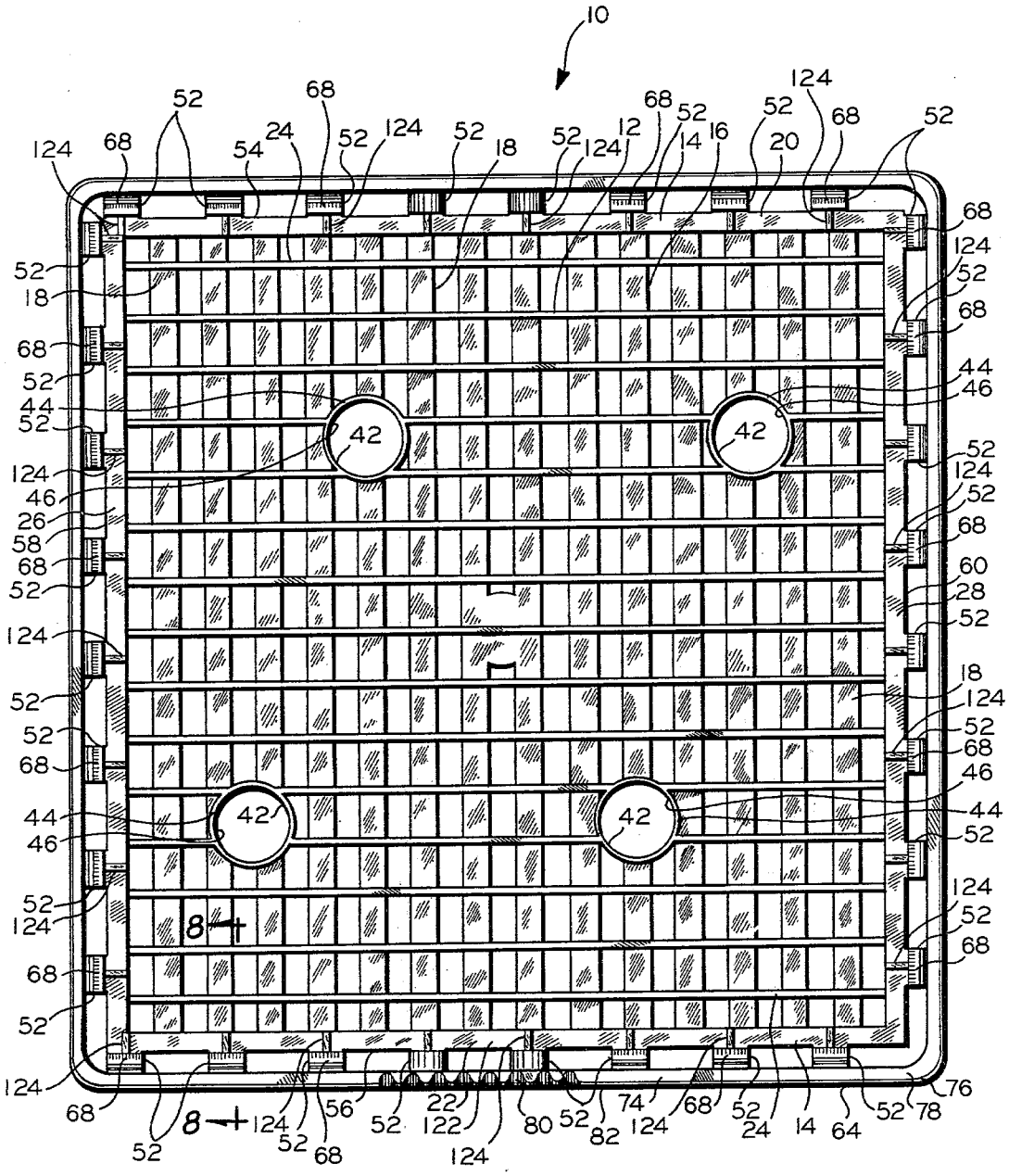
FIG. 6 is a top plan view of the container.
Figure 7:
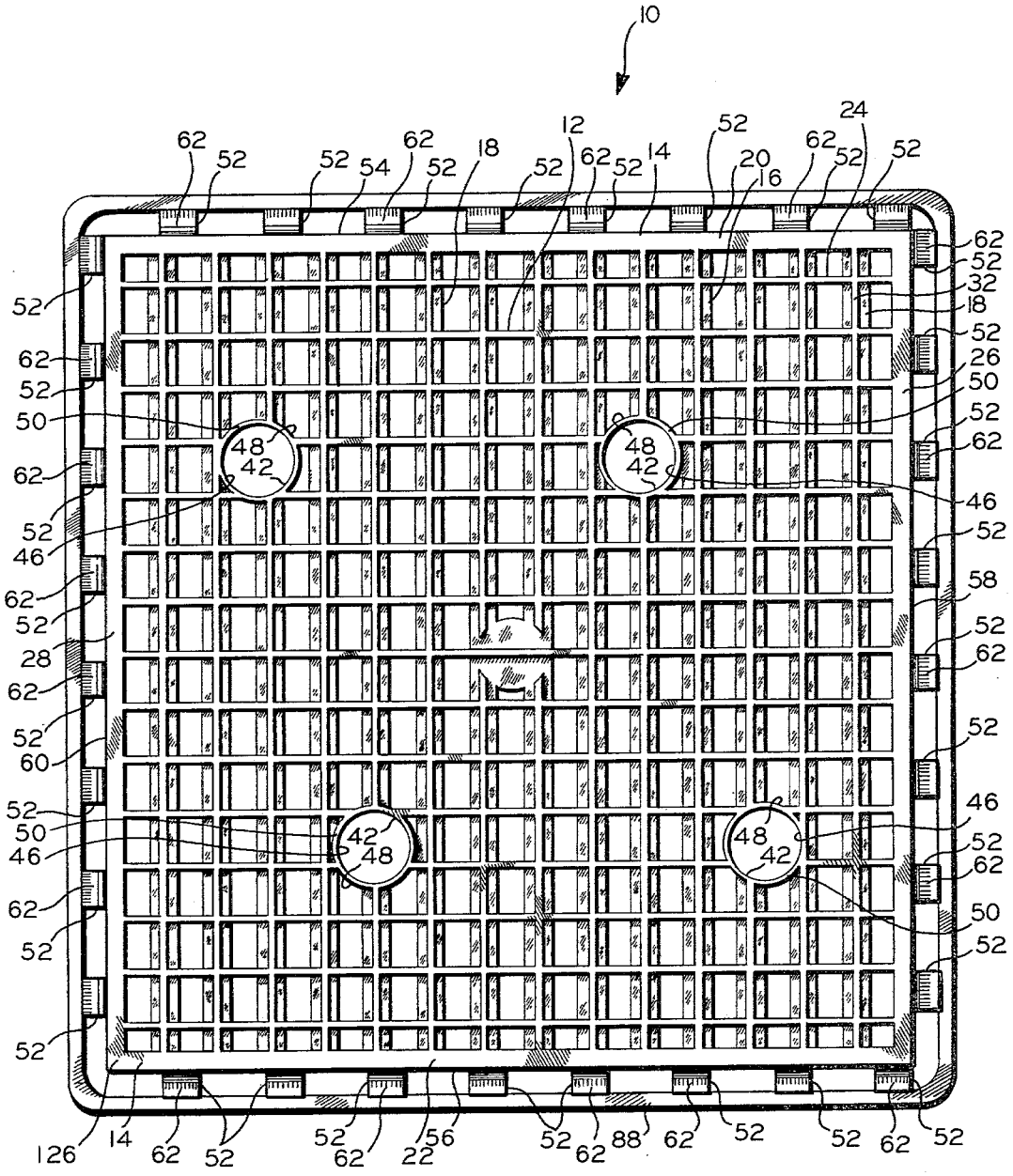
FIG. 7 is a bottom plan view of the container.
Figure 8:
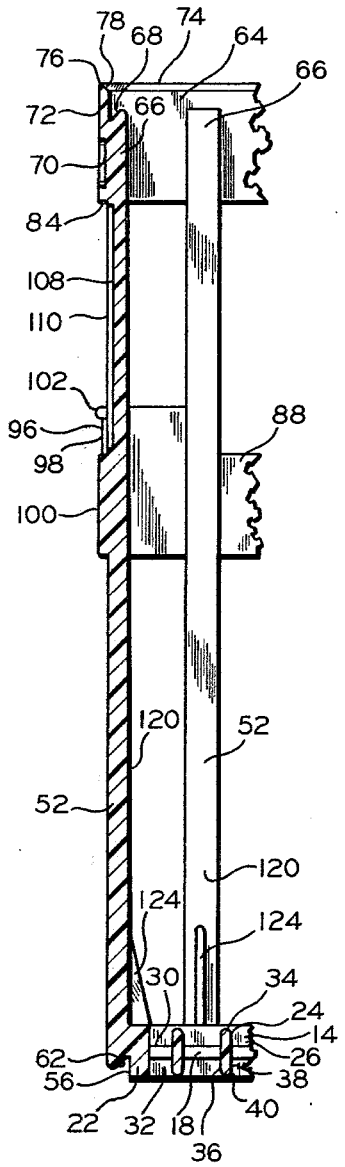
FIG. 8 is a cross-section view taken along line 8—8 of FIG. 6.

Referring now to the drawings, a nestable and stackable container, constructed in accordance with the present invention, is illustrated therein and is generally designated by the reference character 10. The container 10 is especially well adapted for use as an egg crate for carrying fifteen conventional one-dozen egg cartons. The container 10 is of generally rectangular shape and is characterized by a horizontal bottom portion 12 having a generally rectangular outer margin 14 surrounding an open grid structure 16 defined by a plurality of horizontally extending, mutually parallel, generally equally spaced first grid members 18 each aligned at an angle of about 90° to the sides 20 and 22 of the outer margin 14 and by a plurality of horizontally extending, mutually parallel, generally equally spaced second grid members 24 each aligned at an angle of about 90° to the opposite sides 26 and 28 of the rectangular outer margin 14 and intersecting the first grid members 18 at substantially right angles. Each of the first grid members 18 has a substantially T-shaped transverse cross-section defined by a substantially horizontal upper portion 30 and a substantially vertical portion 32 extending downwardly from the medial portion of the horizontal upper portion 30. Each of the second grid members 24 has a transverse cross-section defined by an upper surface 34, a pair of horizontally spaced side surfaces 36 and 38 extending substantially vertically downwardly from the upwardly facing surface 34 and a downwardly facing surface 40 extending between the horizontally spaced side surfaces 36 and 38.

The open grid structure 16 further includes four vertically oriented, cylindrically shaped members 42 interposed in spaced relation in at least a portion of the first and second grid members 18 and 24. Each member 42 has an upper surface 44 substantially horizontally coplanar with the upwardly facing surfaces 34 of the second grid members 24, concentric inner and outer cylindrical surfaces 46 and 48 extending substantially vertically downwardly from the upper surface 44 and a lower surface 50 substantially horizontally coplanar with the downwardly facing surfaces 40 of the second grid members 24.

A plurality of horizontally spaced, substantially vertically oriented members 52 extend upwardly from the outer surfaces 54, 56, 58 and 60 of the respective sides 20, 22, 26 and 28 of the rectangular outer margin 14 forming four substantially vertical sides. Each vertically oriented member 52 is provided with a lower end face 62 which extends downwardly and outwardly from the respective outer surface of the substantially rectangular outer margin 14. While each lower end face 62 can extend downwardly and outwardly from the respective outer surface at any suitable angle, in a preferred embodiment this angle is approximately 45°.

A generally rectangular upper outer rim 64 having a substantially vertical inner surface extends about the upper ends portions 66 of a first group of said vertically oriented members 52. Each of this first group of vertically oriented members 52 is provided with an upper end face 68 which extends upwardly and inwardly from the vertical inner surface of the generally rectangular upper outer rim 64. While each upper end face 68 can extend upwardly and inwardly at any suitable angle, in a preferred embodiment each upper end face 68 extends upwardly and inwardly from the vertical inner surface of the generally rectangular upper outer rim 64 at an angle of approximately 45°.

The generally rectangular upper outer rim 64 is further characterized by a recess 70 in the outer surface 72 thereof opposite the upper end portion 66 of each of the first group of vertically oriented members 52. The upper outer rim 64 is further provided with an upper end end face 74 comprising a substantially horizontal, upwardly facing portion 76 and an upwardly facing chamfered portion 78 which extends downwardly and inwardly from the upwardly facing portion 76, preferably at an angle of approximately 45° from the horizontal. The upwardly facing portion 76 and the chamfered portion 78 are interrupted by a first undulating surface 80 in the medial portion of one side 82 of the upper outer rim 64. The first undulating surface 80 provides convenient visual and tactile means for determining the orientation of each container 10 for facilitating nesting and stacking of containers described hereinafter.

The generally rectangular upper outer rim 64 further includes a downwardly facing lower end face 84 having a second undulating surface 86 located in the medial portion of the one side 82 of the upper outer rim 64 and beneath the first undulating surface 80. The second modulating surface 86 provides additional visual and tactile means for determining the orientation of each container 10 to facilitate nesting and stacking of containers.

A generally rectangular intermediate outer rim 88 having four corners extends about the outwardly facing surfaces of the medial portions of the vertically oriented members 52. The intermediate outer rim 88 includes four strapping guides 90, 92, 94 and 96 positioned respectively at each corner of the intermediate outer rim 88. Each of the strapping guides is in the form of an upwardly extending projection having a substantially vertical surface 98 recessed horizontally inwardly from the outer surface 100 of the intermediate outer rim 88 and having a horizontally outwardly extending horizontal rib 102 formed along the horizontal upper margin of the substantially vertical surface 98. The horizontally outwardly extending horizontal rib 102 and the generally rectangular intermediate outer rim 88 form a pair of vertically spaced, parallel, horizontal ribs for receiving and vertically positioning a packaging strap or the like wrapped around one or more containers 10.

A first horizontally oriented member 104 is positioned vertically intermediate the upper outer rim 64 and the intermediate outer rim 88 and extends across a plurality of the upwardly extending vertical members 52 beneath the second undulating surface 86 on the upper outer rim 64. A second horizontally oriented member 106 is located vertically intermediate the upper outer rim 64 and the intermediate outer rim 88 on the opposite side of the container 10 from the first horizontally oriented member 104 and extends across a plurality of the upwardly extending vertical members 52.

Each of a plurality of said upwardly extending vertical members 52 has a recess 108 formed in the outwardly facing surface 110 thereof and extending between the upper outer rim 64 and the intermediate outer rim 88. Each of an additional plurality of the upwardly extending vertical members 52 has a first outwardly extending vertical rib 112 formed on the outwardly facing surface 110 thereof extending between the upper outer rim 64 and the first horizontally oriented member 104 and a second outwardly extending vertical rib 114 on the outwardly facing surface 110 thereof extending between the first horizontally oriented member 104 and the intermediate outer rim 88. Each of another additional plurality of the upwardly extending vertical members 52 has a first outwardly extending vertical rib 116 on the outwardly facing surface 110 thereof extending between the upper outer rim 64 and the second horizontally oriented member 106 and a second outwardly extending vertical rib 118 on the outwardly facing surface 110 thereof extending between the second horizontally oriented member 106 and the intermediate outer rim 88.

The inner surface 120 of the lower end portion of each of the upwardly extending vertical members 52 is connected to the upwardly facing surface 122 of the generally rectangular outer margin 14 via a triangular gusset 124.

Figure 9:
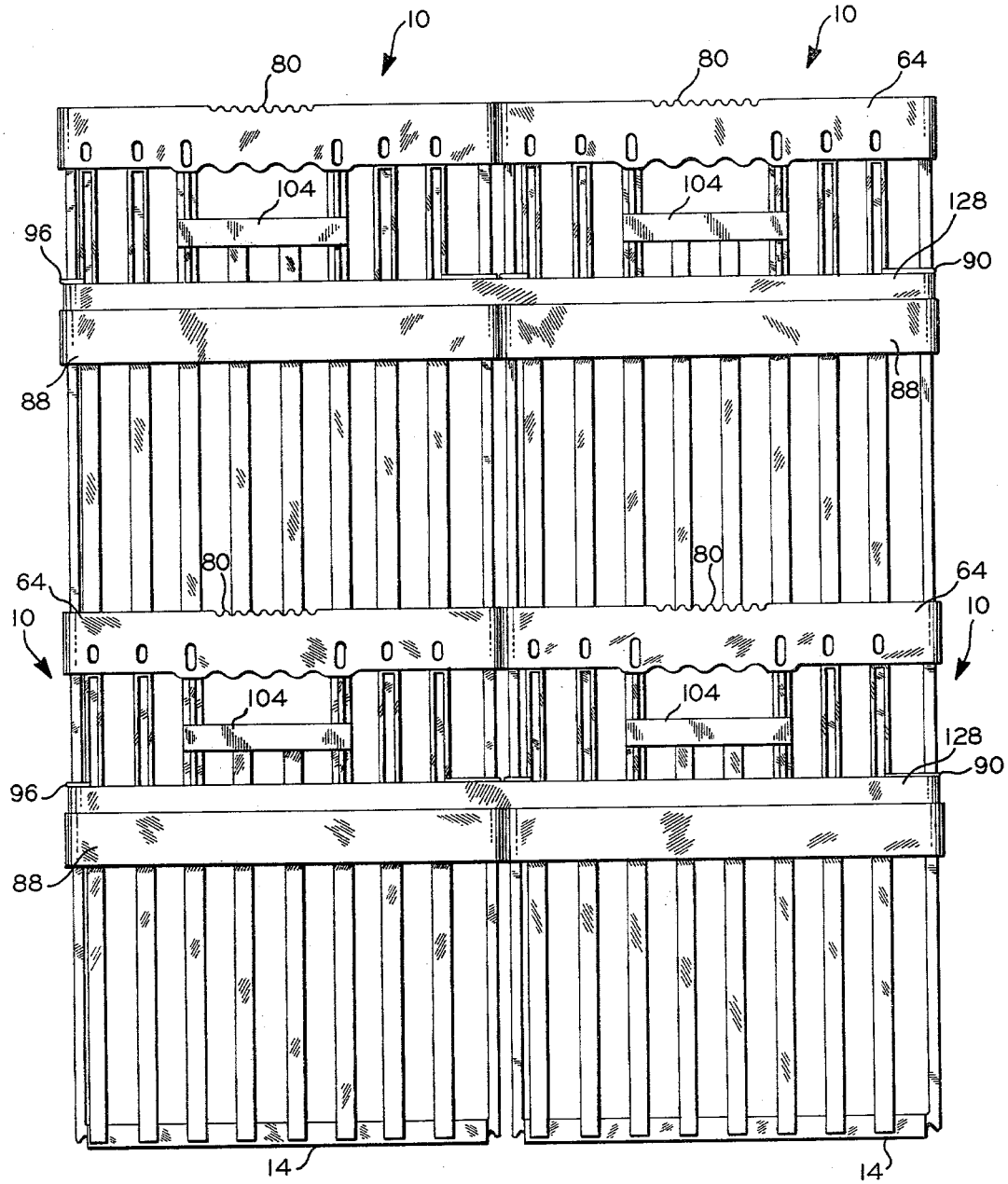
FIG. 9 is an elevation view illustrating four of the containers of the present invention in the stacked position and illustrating packaging strapping material in place.
Figure 10:
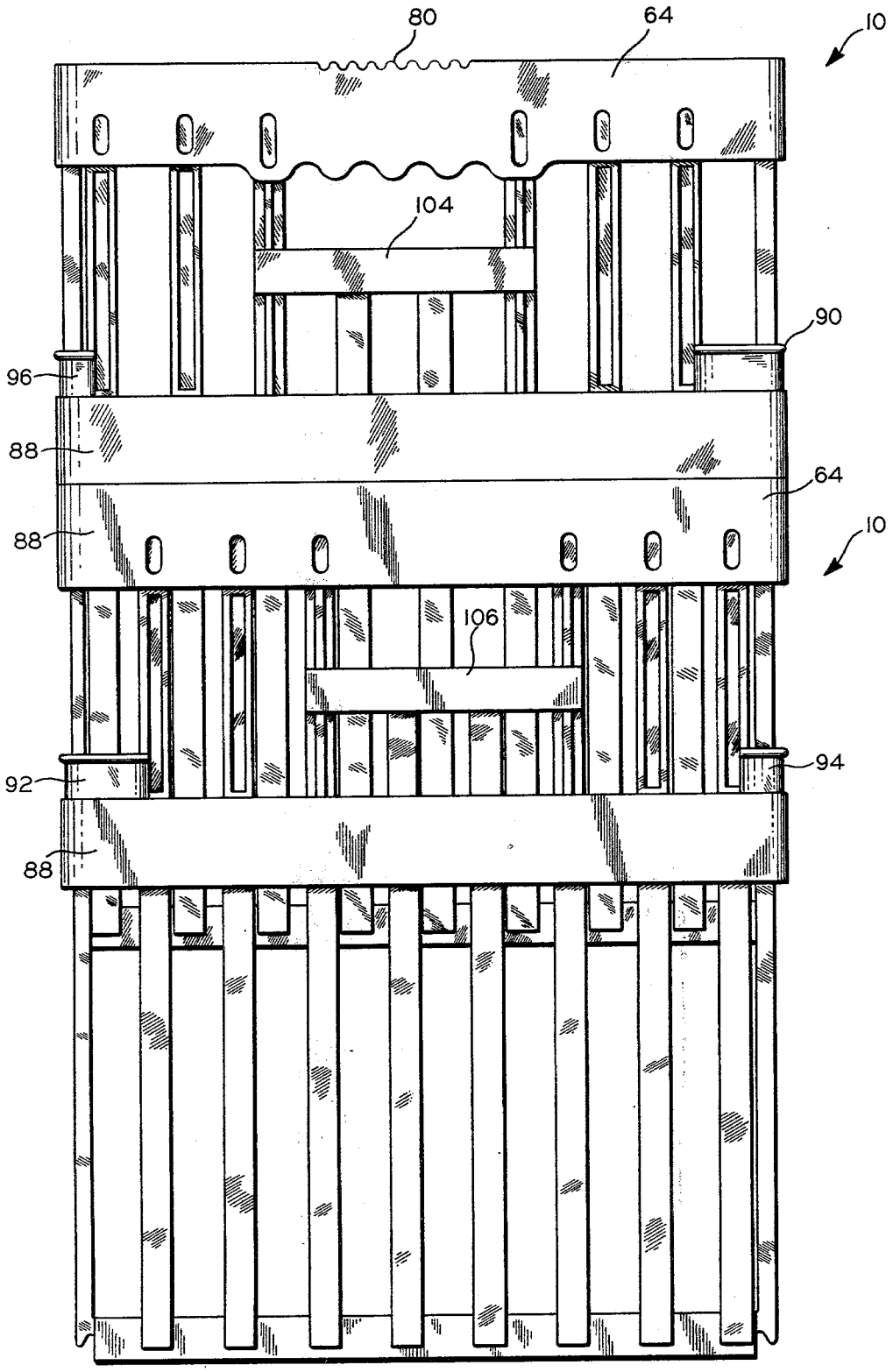
FIG. 10 is an elevation view illustrating two of the containers of the present invention in the nested position.

It will be noted that the lowermost portion of each of the upwardly extending vertical members 52 is spaced a distance vertically upward from the downwardly facing surface 126 of the generally rectangular outer margin 14 thereby protecting the lower end face 62 of each vertically oriented member from damage caused by rough handling of the container 10. The chamfered portion 78 of the upper end face 74 of the upper outer rim 64 facilitates the vertical assembly of a plurality of the containers 10 in either nested or stacked position. It will be noted that the horizontal spacing of the vertically oriented members 52 is such that a plurality of containers 10 can be stacked vertically one on top of the other in a loaded condition when the egg crates are oriented with the first undulating surface 80 of each of the containers positioned vertically one above the other, as shown in FIG. 9. When stacked as shown in FIG. 9, the downwardly facing lower end faces 62 of one container abuttingly engage and are supported by the corresponding upwardly facing upper end faces 68 of the container next below. Conversely, the containers can be stacked in a nested stack, as shown in FIG. 10, with the intermediate outer rim 88 of one container resting on the upper end face 74 of the outer rim 64 of the container next below by stacking the containers with the first undulating surface 80 positioned on alternate sides of the nested stack with the addition of each successive container to the stack.

The container 10 can be formed of any suitable material, however, the container is preferably formed of a unitary mass of any suitable thermoplastic. A suitable method for formation of the container 10 with thermoplastic involves the conventional technique of injection molding. A preferred thermoplastic for the construction of the container 10 is high density polyethylene.

The strapping guides 90, 92, 94 and 96 which form an integral part of each container 10 provide convenient means for receiving and positioning a suitable packing strap 128 therein when strapping multiple containers together in a horizontally oriented assembly, as shown in FIG. 9. The strapping guides provide a recessed, reinforced bearing surface for the packing strapping material thereby protecting the contents of each container, such as fifteen conventional one-dozen egg cartons carried within the container, from possible damage when the packaging straps are pulled tight around the containers. When multiple containers 10 are secured together by means of the packing strap 128 in the manner described, the outside surfaces of the upper outer rims 64 and intermediate outer rims 88 of adjacent containers 10 are maintained in abutting relation as shown in FIG. 9. It should also be noted that, while the strapping guides 90, 92, 94 and 96 are shown positioned adjacent the intermediate outer rim in the illustrated embodiment, it is within the scope of the invention for the strapping guides to be located at any suitable location vertically intermediate the upper and intermediate outer rims. It is also within the scope of the invention to provide a plurality of strapping guides in vertically spaced relation at each corner of a container in vertically spaced relation if desired so that two or more packing straps can be employed to secure multiple containers together.

Other reasonable variations and modifications of the present invention are possible within the scope of the foregoing disclosure, the drawings and the appended claims.

That which is claimed is:

1. A container adapted to alternately stack and nest with a container of identical size and shape, comprising:

a generally rectangular bottom portion;

four substantially vertical sides extending upwardly from said bottom portion, said vertical sides including a series of spaced generally vertical members having upper and lower end portions, said generally vertical members being arranged so that in a stacking position the lower end portions of at least a portion of said generally vertical members are supported by the upper end portions of at least a portion of said generally vertical members of an identically oriented lower container and said generally vertical members being arranged so that by rotating an upper container with respect to the lower container each generally vertical member of the upper container is received within a space between adjacent generally vertical members in the non-identically oriented lower container so as to provide a nesting position;

a generally rectangular upper outer rim extending about the upper end portions of at least a portion of said generally vertical members;

a generally rectangular intermediate outer rim extending about at least a portion of said generally vertical members intermediate the upper and lower end portions thereof, said generally rectangular intermediate outer rim having four corners; and a strapping guide positioned adjacent each of said corners of said generally rectangular intermediate outer rim and comprising an upwardly extending projection at a respective corner of said generally rectangular outer intermediate rim, said upwardly extending projection having a generally vertical surface recessed inwardly from the generally vertical outer surface of said generally rectangular intermediate outer rim and having a horizontally outwardly extending rib along a horizontal upper margin of said upwardly extending projection.

2. A container in accordance with claim 1 wherein the outer surface of each side of said intermediate outer rim and the outer surface of the corresponding side of the outer surface of the upper outer rim lie in the same substantially vertical plane and the outwardly extending rib of each said strapping guide extends outwardly no further than the outer surface of the underlying intermediate outer rim.

3. A container in accordance with claims 2 or 3 wherein the vertical surface of each said strapping guide extends from a generally vertical member of one wall to a generally vertical member of the adjacent intersecting wall.

4. A stackable and nestable container comprising:

a generally rectangular bottom portion having a generally rectangular outer margin having first, second, third and fourth sides and a downwardly facing surface;

a plurality of horizontally spaced, substantially vertically oriented members, each said member having an upper end portion, a medial portion and an outwardly facing surface and extending upwardly from a respective one of said first, second, third and fourth sides of said generally rectangular outer margin;

a lower end face on each of at least a portion of said substantially vertically oriented members extending downwardly and outwardly from a respective one of said sides of said generally rectangular outer margin and spaced a distance vertically upward from said downwardly facing surface of said generally rectangular outer margin;

a generally rectangular upper outer rim extending about said upper end portions of at least a portion of said substantially vertically oriented members, said generally rectangular upper outer rim having an upper end face comprising a substantially horizontal upwardly facing portion and an upwardly facing chamfered portion extending downwardly and inwardly from said substantially horizontal upwardly facing portion, and having a substantially vertical inner surface;

an upper end face on each of at least a portion of said substantially vertically oriented members extending upwardly and inwardly from said substantially vertical inner surface of said generally rectangular upper outer rim and spaced a distance vertically downward from said upper end face of said generally rectangular upper outer rim;

a generally rectangular intermediate outer rim extending about said outwardly facing surfaces of said medial portion of at least a portion of said substantially vertically oriented members, said generally rectangular intermediate outer rim having four corners, a generally vertical outer surface and a downwardly facing end face; and strapping guide means positioned adjacent each of said corners of said generally rectangular intermediate outer rim and comprising an upwardly extending projection at a respective corner of said generally rectangular intermediate outer rim, said upwardly extending projection having a generally vertical surface recessed inwardly from the generally vertical outer surface of said generally rectangular intermediate outer rim and having a horizontally outwardly extending rib along a horizontal upper margin of said upwardly extending projection.

5. A container in accordance with claim 4 wherein the outer surface of each side of said intermediate outer rim and the outer surface of the corresponding side of the outer surface of the upper outer rim lie in the same substantially vertical plane and the outwardly extending rib of each said strapping guide extends outwardly no further than the outer surface of the underlying intermediate outer rim.

6. A container in accordance with claims 4 or 5 wherein the vertical surface of each said strapping guide extends from a generally vertical member of one wall to a generally vertical member of the adjacent intersecting wall.

* * * * *